US005927776A

United States Patent [19]

Kiss

[11] Patent Number: 5,927,776

[45] Date of Patent: Jul. 27, 1999

[54] DOOR HANDLE EXTENSION

[76] Inventor: Stephen M. Kiss, 5257 Primrose Rd., Lowell, Ark.

[21] Appl. No.: 08/977,695

[22] Filed: Nov. 25, 1997

[51] Int. Cl.[6] ..... E05B 3/00

[52] U.S. Cl. ..... 292/348; 292/358; 292/351

[58] Field of Search ..... 292/348, 349, 292/350, 351, 352, 353, 354, 355, 358, 359; 16/121

[56] References Cited

U.S. PATENT DOCUMENTS

| | | | |
|---|---|---|---|
| 396,571 | 1/1889 | Iddings et al. | 292/359 |
| 1,967,152 | 7/1934 | Lyons | 292/351 |
| 3,044,817 | 7/1962 | Marcante | 292/348 |
| 3,091,490 | 5/1963 | Williams | 292/352 |
| 3,592,499 | 7/1971 | Elson et al. | 292/347 |
| 3,823,585 | 7/1974 | Spon | 292/359 |

FOREIGN PATENT DOCUMENTS

| | | | |
|---|---|---|---|
| 486237 | 9/1952 | Canada | 292/353 |
| 576096 | 5/1959 | Canada | 292/358 |
| 17964 | 8/1904 | United Kingdom | 292/351 |

OTHER PUBLICATIONS

Photocopy of page from Andersen Catalog, Dated 1998.

*Primary Examiner*—Darnell M. Boucher
*Assistant Examiner*—Stephen Grady
*Attorney, Agent, or Firm*—Head, Johnson & Kachigian

[57] ABSTRACT

A door handle extension apparatus which improves existing door handle/locksets specifically extending the handle portion of a door handle/lockset thus allowing unincumbered use of the handle portion of the lockset. In one embodiment, the invention utilizes an extender which moves the handle portion away from the door. A shaft located within the extender transfers the force applied to the handle portion to the latch locksets located within the door portion. In another embodiment, a conventional handle portion of a lockset has been modified to include an elongated neck which spaces the handle away from the door to accommodate mini-blinds and the like.

4 Claims, 5 Drawing Sheets

DOOR HANDLE EXTENSION

BACKGROUND OF THE INVENTION

1. Field of the Invention.

The present invention relates to a door handles, locksets, and components thereof, more particularly to an apparatus which extends the handle portion of the door handle/lockset away from the door portion of the lockset to accommodate curtains, blinds, and the like.

Doors are made out of many different types of materials and some include glass panes within them, specifically, French doors which include multiple panes of glass. In order to insure privacy many people place a covering over this glass. This covering is in the form of drapes, curtains, blinds, mini-blinds, vertical or horizontal venetian blinds or other material. However, when certain curtains or blinds, such as mini-blinds, are placed over the glass the door handle is effectively covered or blocked thus making access to the door handle difficult.

One type of door handle lock lockset used with French doors is commonly referred as a quick-set lockset. This lockset includes a door portion and a handle portion wherein the handle portion has a shaft which fits within an opening located within the door portion of the lockset. When force is applied to the handle, the shaft is used to transfer that force to the latch locksets located within the door portion. The handle portion is designed in such a manner as to snap within the door portion of the lockset in a very quick and efficient manner. When installed, the distance the handle portion rests from the door is usually not far enough removed from the door as to be easily accessible when mini-blinds or other types of window coverings are used.

There is a need for an improved handle or a lockset having device which extends the handle portion of the lockset in order to allow unincumbered access to the handle while still being able to utilize mini-blinds or other such window covering material.

2. Prior Art

As far as is known, there is no device which satisfies the above mentioned need. Campion, U.S. Pat. No. 4,876,783 discloses a method and apparatus for conversion of a door knob lockset. Generally, this disclosure focuses on providing a universal door knob which is adapted for mounting in association with the hardware systems of a variety of types or designs of manufacture. It does not, however, disclose or discuss the extension of the door handle portion of a lockset.

Dittman, U.S. Pat. No. 5,231,733, is directed toward an aid for grasping round knobs and includes a hand-held grasping element which when positioned over a round door knob is able to assist a person in manipulating the door in which the round knob is attached. Matthews, U.S. Pat. No. 3,656,793, is directed toward an extension for bath faucet valve operators and includes a hand-held device similar to that in the Dittman patent. This device includes a hand-held conically shaped element which engages bathtub or shower faucet handles. Like the Dittman patent this device is hand-held and does not teach the technology of extending the handle portion of a lockset away from the door portion of a lockset.

Other patents include Katayama et al., U.S. Pat. No. 5,605,064, directed toward a door lock for handicap persons; Fayerman et al., U.S. Pat. No. 4,502,720, directed toward a door latch apparatus; Lind, U.S. Pat. No. 4,397,489, directed toward a lever adapter for a door knob; McCoy et al., U.S. Pat. No. 4,285,536, directed toward a universal lever handle attachment for a door knob, and also U.S. Pat. Nos. 5,219,192, 3,093,400 and 2,947,561.

SUMMARY OF THE INVENTION

The present invention is directed to an apparatus which extends the handle portion of a lockset. There are embodiments of the invention, and extension or adapter includes an extending shaft having a female end which fits within the shaft portion of the handle assembly and a male portion which fits within the female portion of the door assembly. The extension shaft is able to transfer the force received from the handle to the latch locksets located within the door assembly by means of the shaft.

The extension or adapter also includes an extender in which the extending shaft is placed within. The extender is cylindrical in nature and is designed to the same diameter as the lockset. The extender has attachment means which attach to both the handle portion and the door portion of the lockset. A sleeve is placed over the extender in order to protect it as well as for aesthetic purposes. Snap rings or other securing means are used to secure the extender to the lockset.

In accordance with another embodiment of the present invention, a conventional handle portion of a quick-set lockset has been modified to include an elongated neck which spaces the handle away from the door to accommodate mini-blinds and the like.

One object of the present invention is to provide an apparatus which will allow access to a door handle when otherwise the handle would be encumbered by mini-blinds or other types of coverings.

Another more particular object of the present invention is the provision of an extension for a lockset.

Yet another object of the present invention is a quick-set lockset handle portion having an elongated neck.

The drawings constitute a part of the specification and include exemplary embodiments of the present invention while illustrating various objects and features thereof.

DETAILED DESCRIPTION OF THE PREFERRED EMBODIMENTS

Figure 1:
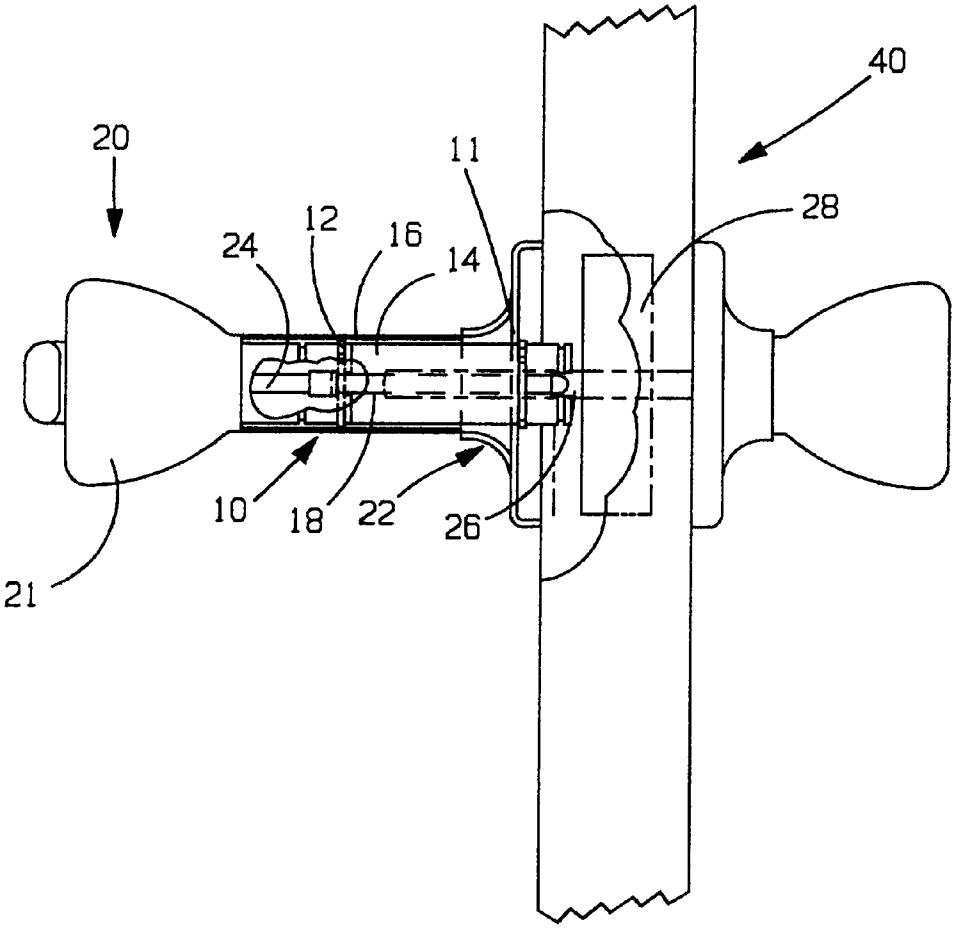
FIG. 1 is a perspective view illustration of a door-handle arrangement having a handle extender in accordance with the present invention.
Figure 2:
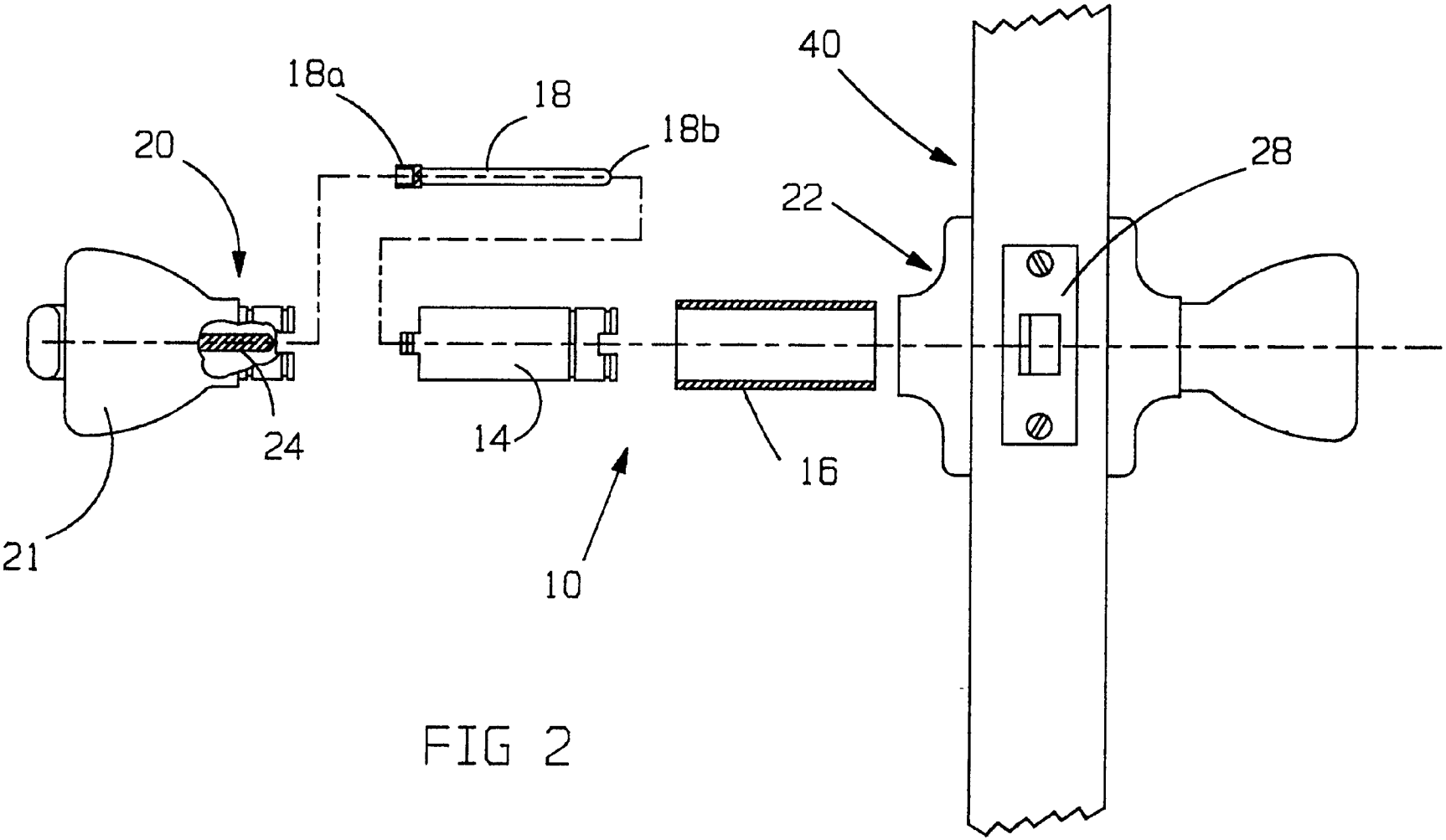
FIG. 2 is an exploded perspective of the handle extender of FIG. 1.

Referring now to FIG. 1 of the drawings, a conventional door 40 having a door portion 22, a door handle arrangement including an extension 10 in accordance with an embodiment of the present invention and a handle portion 20 is shown in a perspective view of the present invention. As shown in FIG. 2, handle portion 20 includes latch bar 24. Further, door portion 22 has a lock rod 26 and a conventional door latch mechanism 28.

Figure 3:
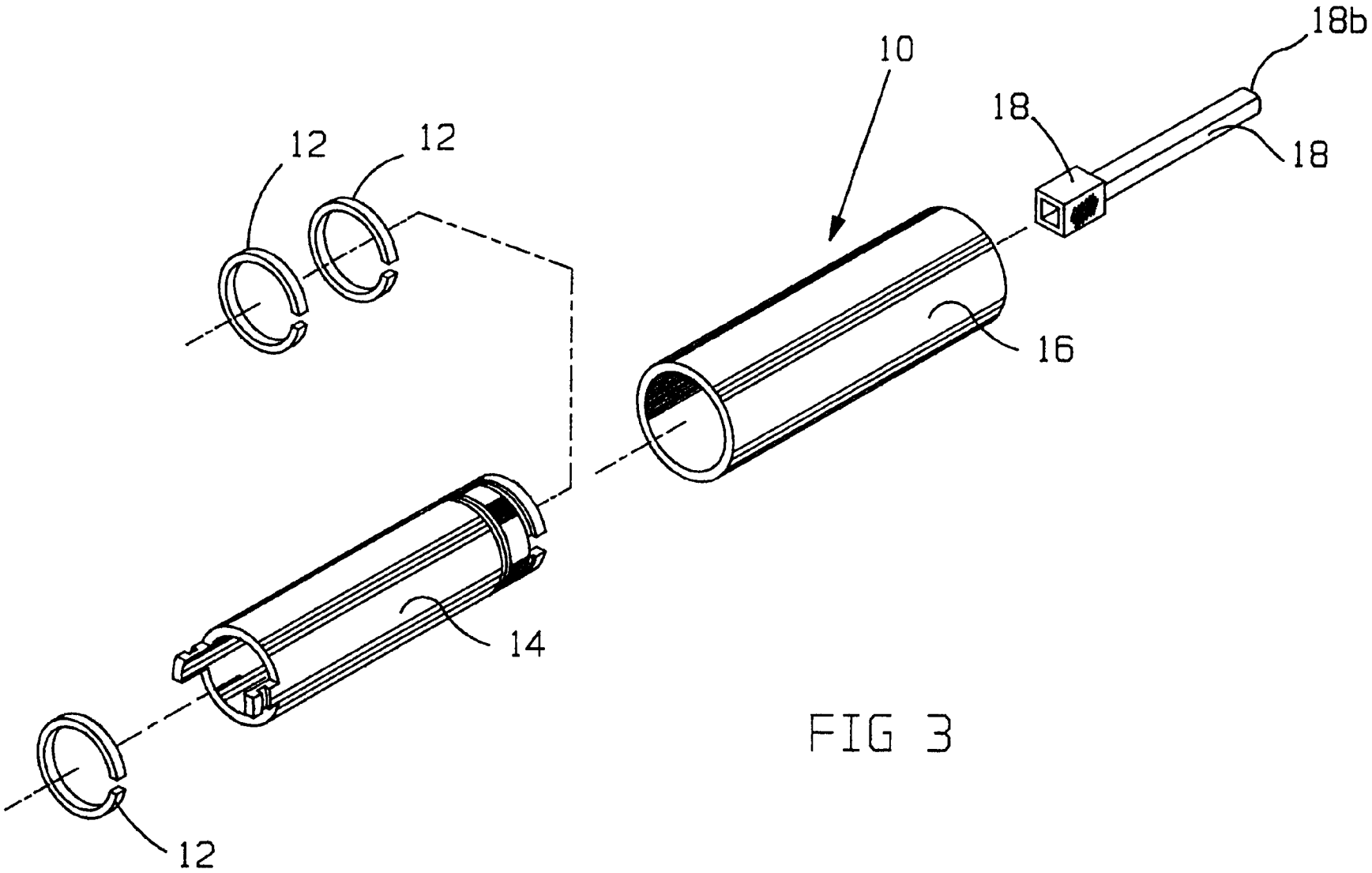
FIG. 3 is an exploded perspective view of the handle extender of FIG. 1.
Figure 4:
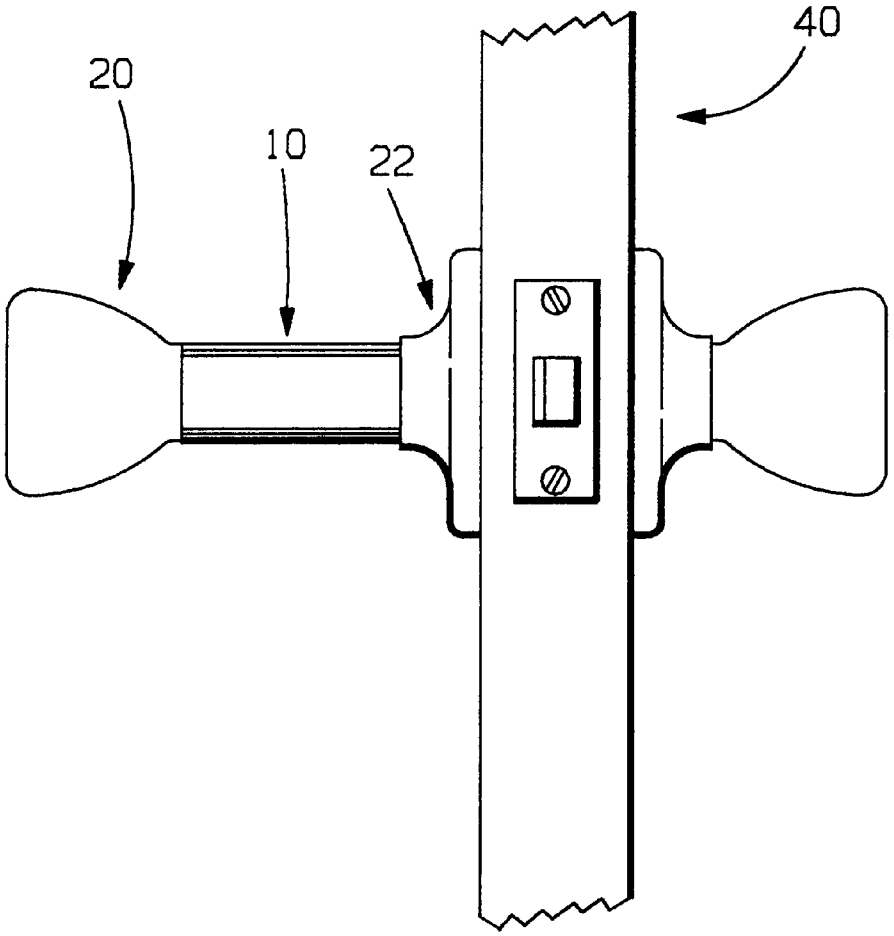
FIG. 4 is a top plain view of an installed door-handle arrangement of FIG. 1.

As shown in FIGS. 1 and 3, door handle extension 10 includes an extender 14, sleeve 16, lock button extension shaft 18, and a plurality of snap rings 12. As shown, lock button extension shaft 18 fits within extender 14 which in turn fits within sleeve 16. Female portion 18*a* of lock button extension shaft 18 fits within male portion 24 of latch bar 24 while the male portion 18*b* of lock button extension shaft 18 fits within the female portion 26 lock rod of door portion 22.

Extender 14 is connected to handle portion 20 and door portion 22 respectively, of snap rings 12.

Figure 6:
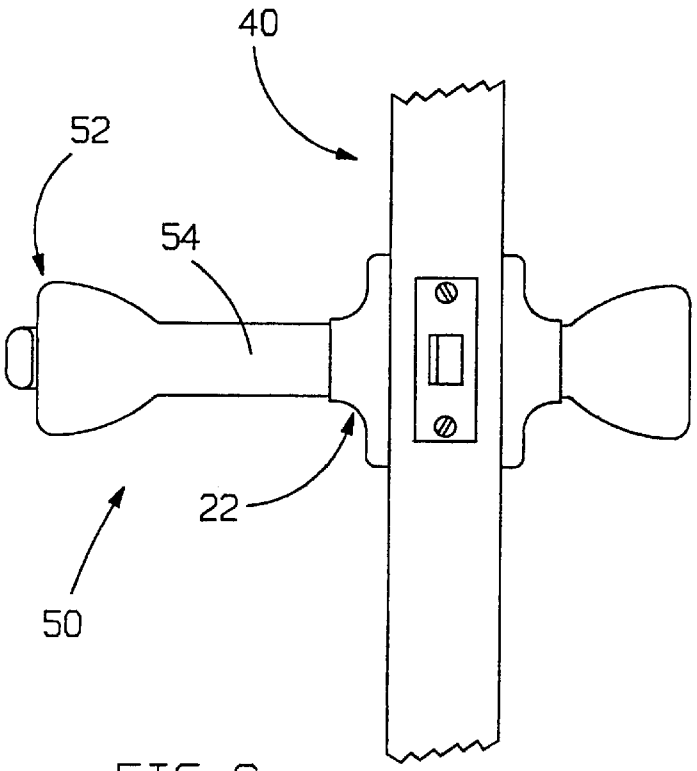
FIG. 6 is a top plain view of an installed Kwik-set lockset of FIG. 5.
Figure 5:
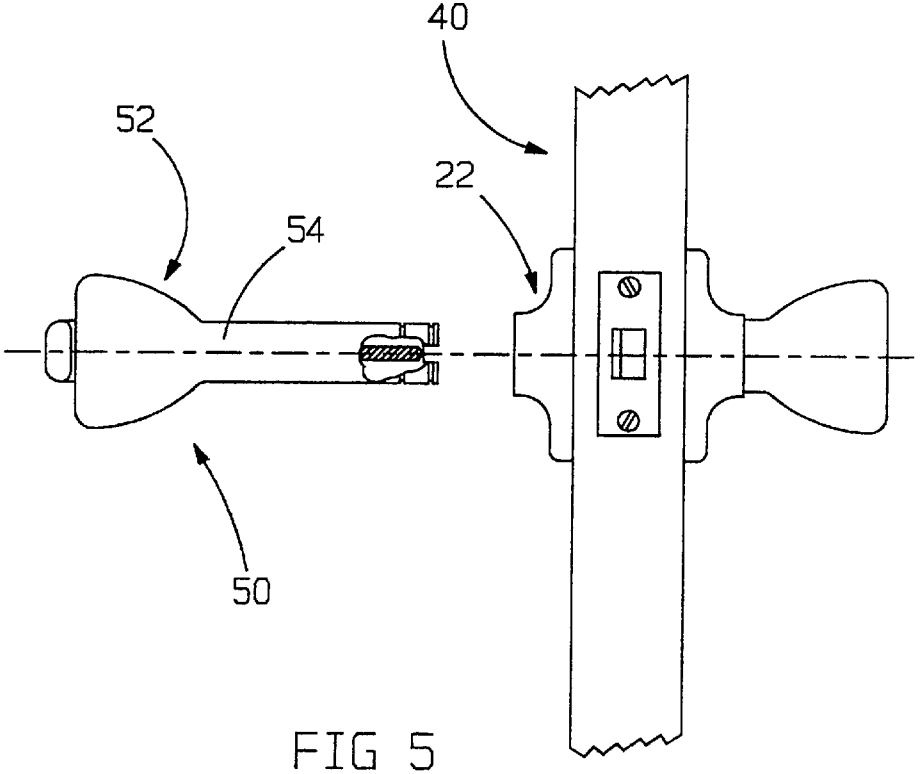
FIG. 5 is an exploded top view illustration of a modified Kwik-set fockset having a modified handle portion.

In accordance with another embodiment of the present invention, as shown in FIG. 5–6 of the drawings, a conventional Kwikset lockset 50 has been modified to include a handle portion 52 and having an elongated neck 54 which spaces the handle portion 52 from the door 40 to accommodate mini-blinds and the like.

By employing the structure of the present invention, a person may gain access to a door handle, especially the door handles of a French door, while at the same time being able to utilize mini-blinds or other such coverings.

Whereas, the present invention has been described in relation to the drawings attached hereto, it should be understood that other and further modifications, apart from those shown or suggested herein, may be made within the spirit and scope of this invention.

What is claimed is:

1. An apparatus to modify a lockset having a handle portion and a door portion, wherein the handle portion has a shaft and the door portion having an opening to receive said shaft, with the apparatus comprising:

an extender having a first end and a second end with the first end being able to be attached to the door portion of the lockset and the second end being able to be attached to the handle portion of the lockset, with the extender being cylindrical, having an external surface and having a longitudinal bore along the entire length of the extender, with bore having an internal surface, a sleeve having a first end and a second end, said sleeve being a hollow cylinder, having an external surface and an internal surface, with the extender being placed within the sleeve wherein the external surface of the extender is in contact with the internal surface of the sleeve, a lock button extension shaft having a first end and a second end, with the first end being located proximate to the first end of the extender and having a bore for attachment to said handle portion and the second end being located proximate to the second end of the extender and being able to be attached to the door portion of the lockset and wherein said lock button extension shaft is placed within the bore of the extender, and connection means to secure the first end of the extender to the door portion of the lockset and connection means in order to secure the second end of the extender to the handle portion of the lockset.

2. An apparatus to modify a lockset having a handle portion and a door portion, wherein the handle portion has a shaft and the door portion having an opening to receive said shaft, with the apparatus comprising:

an extender having a first end and a second end with the first end being able to be attached to the door portion of the lockset and the second end being able to be attached to the handle portion of the lockset, with the extender being cylindrical, having an external surface and having a longitudinal bore along the entire length of the extender, with bore having an internal surface, a sleeve having a first end and a second end, said sleeve being a hollow cylinder having an external surface and an internal surface, with the extender being placed within the sleeve wherein the external surface of the extender is in contact with the internal surface of the sleeve and the first end of the extender is located proximate to the first end of the sleeve and the second end of the extender is located approximate to the second end of the sleeve, a lock button extension shaft having a first end and a second end, with the first end having a bore for attachment to said handle portion and the second end being able to be attached to the door portion of the lockset and wherein said lock button extension shaft is placed within the bore of the extender, and connection means to secure the first end of the extender to the door portion of the lockset and connection means in order to secure the second end of the extender to the handle portion of the lockset.

3. An apparatus to modify a lockset with the mechanism having a handle portion and a door portion, wherein the handle portion has a shaft and the door portion having an opening to receive said shaft, with the apparatus comprising:

an extender having a first end and a second end with the first end being able to be attached to the door portion of the lockset and the second end being able to be attached to the handle portion of the lockset, with the extender being cylindrical, having an external surface and having a longitudinal bore along the entire length of the extender, with bore having an internal surface, a sleeve having a first end and a second end, said sleeve being a hollow cylinder, having an external surface and an internal surface, with the extender being placed within the sleeve wherein the external surface of the extender is in contact with the internal surface of the sleeve, wherein the first end of the extender is located proximate to the first end of the sleeve and the second end of the extender is located proximate to the second end of the sleeve, a lock button extension shaft having a first end and a second end, with the first end having a bore in which to receive the shaft located within the handle portion of the lockset, and the second end fits within the opening of the door portion of the lockset, wherein said lock button extension shaft in placed within the bore of the extender, and wherein the first end of the lock button extension shaft is located proximate to the first end of the extender and the second end of the lock button extension shaft is located proximate to the second end of the extender, and snap rings to secure the first end of the extender to the door portion of the door handle/lockset and snap rings in order to secure the second end of the extender to the handle portion of the lockset.

4. The apparatus of claim 3 wherein the sleeve has an exterior finish which matches the exterior finish of the handle portion.

* * * * *